US006880871B2

(12) United States Patent
Winardi

(10) Patent No.: US 6,880,871 B2
(45) Date of Patent: Apr. 19, 2005

(54) DRIVE-IN LATCH WITH ROTATIONAL ADJUSTMENT

(75) Inventor: Michael Winardi, Fullerton, CA (US)

(73) Assignee: Newfrey LLC, Newark, DE (US)

( * ) Notice: Subject to any disclaimer, the term of this patent is extended or adjusted under 35 U.S.C. 154(b) by 0 days.

(21) Appl. No.: 10/235,390

(22) Filed: Sep. 5, 2002

(65) Prior Publication Data

US 2004/0046402 A1 Mar. 11, 2004

(51) Int. Cl.[7] ..... E05B 9/00
(52) U.S. Cl. ..... 292/337; 292/1.5
(58) Field of Search ..... 292/1.5, 337, DIG. 60

(56) References Cited

U.S. PATENT DOCUMENTS 4,671,549 A * 6/1987 Marotto ..... 292/333
4,687,239 A * 8/1987 Lin ..... 292/172
4,759,576 A * 7/1988 Ching ..... 292/1.5
5,039,146 A * 8/1991 Lin ..... 292/337
5,211,432 A * 5/1993 Lin ..... 292/169
5,364,138 A * 11/1994 Dietrich ..... 292/1.5
5,489,128 A * 2/1996 Florian ..... 292/1.5
5,562,314 A * 10/1996 Wheatland ..... 292/1.5
5,769,472 A * 6/1998 Small ..... 292/337

* cited by examiner

*Primary Examiner*—Gary Estremsky
(74) *Attorney, Agent, or Firm*—Richard J. Veltman; John D. Del Ponti

(57) ABSTRACT

At least one exemplary embodiment of the present invention provides a removable drive-in housing assembly for securing a latch assembly in a door. The removable drive-in housing assembly can include a cylindrical casing having a longitudinal axis, the casing adapted to at least partially surround the latch assembly. The removable drive-in housing assembly also can include a unitary cylindrical inner collar removably receivable around an outer circumference of the cylindrical casing. Further, the removable drive-in housing assembly can include a unitary cylindrical outer collar removably receivable around an outer circumference of the inner collar. It is emphasized that this abstract is provided to comply with the rules requiring an abstract that will allow a searcher or other reader to quickly ascertain the subject matter of the technical disclosure. This abstract is submitted with the understanding that it will not be used to interpret or limit the scope or meaning of the claims. 37 CFR 1.72(b).

22 Claims, 8 Drawing Sheets

FIG. 5

DRIVE-IN LATCH WITH ROTATIONAL ADJUSTMENT

BRIEF DESCRIPTION OF THE DRAWINGS

The invention and its wide variety of potential embodiments will be readily understood via the following detailed description of certain exemplary embodiments, with reference to the accompanying drawings in which.

DETAILED DESCRIPTION

Certain embodiments of the present invention can include a removable drive-in housing assembly for securing a latch assembly in a door. The removable drive-in housing assembly can include a cylindrical casing having a longitudinal axis, the casing adapted to at least partially surround the latch assembly. The removable drive-in housing assembly also can include a unitary cylindrical inner collar removably receivable around an outer circumference of the cylindrical casing. Further, the removable drive-in housing assembly can include a unitary cylindrical outer collar removably receivable around an outer circumference of the inner collar.

Figure 1:
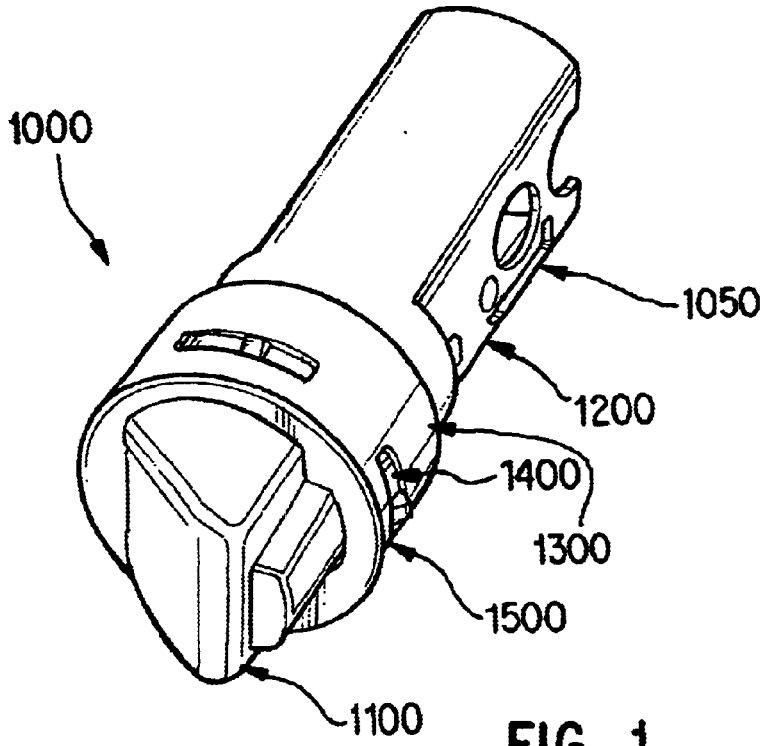
FIG. 1 is a 3-dimensional front perspective view of an exemplary embodiment of a system 1000 of the present invention.
Figure 2:
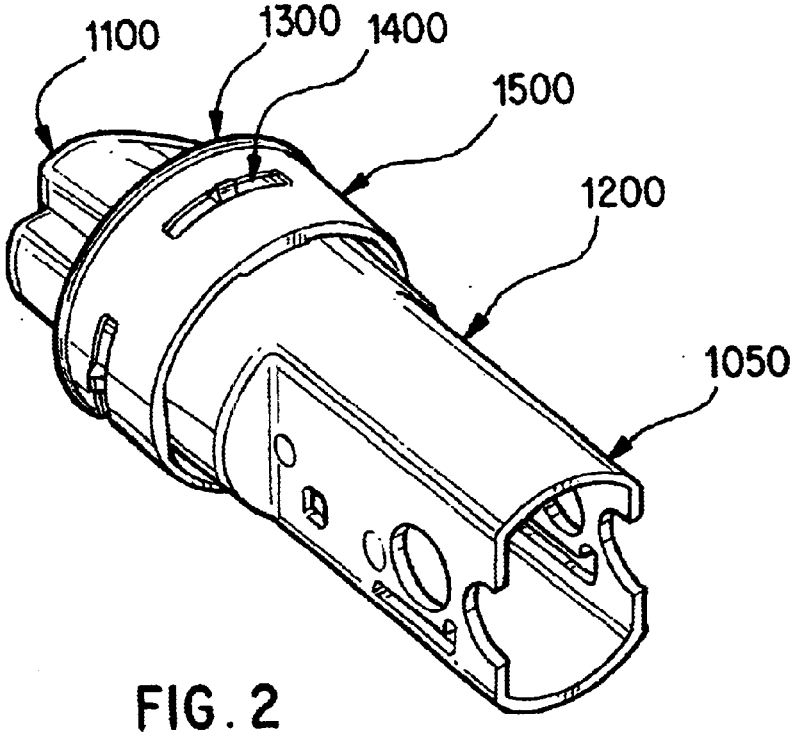
FIG. 2 is a 3-dimensional rear perspective view of an exemplary embodiment of a system 1000 of the present invention.

FIG. 1 is a 3-dimensional front perspective view, and FIG. 2 is a 3-dimensional rear perspective view, of an exemplary embodiment of a removable drive-in door latching system 1000 of the present invention. In this particular exemplary embodiment, system 1000 includes a latch assembly 1100 and a removable drive-in housing assembly 1050, which includes a generally cylindrical casing 1200 and collar assembly 1300. Latch assembly 1100 is at least partially contained within casing 1200 and is adapted to be coupled to a door grasp, such as a door knob, door handle, or other door grasping means, and is further adapted to be coupled to the door to latch the door in a predetermined position (such as the closed position). Surrounding a portion of casing 1200 can be a collar assembly 1300, which can include inner collar 1400 and outer collar 1500. Inner collar 1400 can include an engagement mechanism to releasably engage inner collar 1400 with the door.

Inner collar 1400 can resemble an axially-extended annulus. That is, inner collar 1400 can be generally cylindrical, hollow, and of a one-piece, unitary construction, having a generally circular longitudinal cross-section that defines an inner generally-circumferential surface and/or wall and an outer generally-circumferential surface and/or wall. Alternatively, inner collar 1400 can comprise at least one removable component. In another alternative embodiment, inner collar 1400 can have a generally polygonal longitudinal cross-section that defines an inner perimeter and an outer perimeter. Any portion of inner collar 1400 can be fabricated of metal, polymer, and/or the like, such as an injection molded plastic (e.g., polyethylene, LDPE, HDPE, and/or nylon, etc.).

Outer collar 1500 also can resemble an axially-extended annulus. That is, outer collar 1500 can be generally cylindrical, hollow, and of a one-piece, unitary construction, having a generally circular longitudinal cross-section that defines an inner generally circumferential surface and an outer generally circumferential surface. Alternatively, outer collar 1500 can comprise at least one removable component. In another alternative embodiment, outer collar 1500 can have a generally polygonal longitudinal cross-section that defines an inner perimeter and an outer perimeter. Any portion of outer collar 1500 can be fabricated of metal, polymer, or the like, such as a drawn metal (e.g., steel, brass, etc.).

Prior to installation, outer collar 1500 can be slid over inner collar 1400, which can be slid over casing 1200 to form removable drive-in housing assembly 1050. In certain embodiments, either of these sliding actions can performed manually, without the aid of any tools. In some embodiments, either of these sliding actions can performed with the assistance of tools and/or automatically. In certain embodiments, either of these sliding actions can be performed non-destructively.

Likewise, prior to installation, either collar assembly 1300 or inner collar 1400 can be removed from casing 1200, and outer collar 1500 can be removed from inner collar 1400. In certain embodiments, either of these removals can be performed non-destructively. In some embodiments, either of these removals can be performed manually, without the aid of any tool. In certain embodiments, a general purpose and/or special purpose tool can be employed.

During installation, removable drive-in housing assembly 1050 can be driven into a bore of the door until a flange of outer collar 1500 contacts the door, thereby at least partially securing casing 1200 longitudinally in door. Then, latch assembly 1100 can be inserted into removable drive-in housing assembly 1050.

Once installed, the engagement mechanism(s) of inner collar 1400 can releasably fix inner collar, both rotationally and longitudinally, with respect to the door. Casing 1200 and outer collar 1500 can be a least partially free to rotate and/or can be partially rotationally adjustable, with respect to inner collar 1400 and the door, to compensate for some misalignments, such as misalignment of latch assembly 1100 relative to the door. Outer collar 1500 can be releasably fixed in rotation relative to casing 1200. Collar assembly 1300, inner collar 1400, and/or outer collar 1500 can be releasably fixed longitudinally with respect to casing 1200.

Once installed, collar assembly 1300 can hold latch assembly securely inside the door. Assuming that outer collar 1500 is fabricated of a strong and/or attractive metal, collar assembly 1300 can show mostly metal to optimize strength and/or aesthetics. If desired, drive-in housing assembly 1050 and/or latch assembly 1100 can be relatively easily and non-destructively removed from the door. Moreover, once drive-in housing assembly 1050 has been removed from the door, the door can be relatively easily converted from a drive-in latch design to a mortised screwed-on faceplate design.

Figure 3:
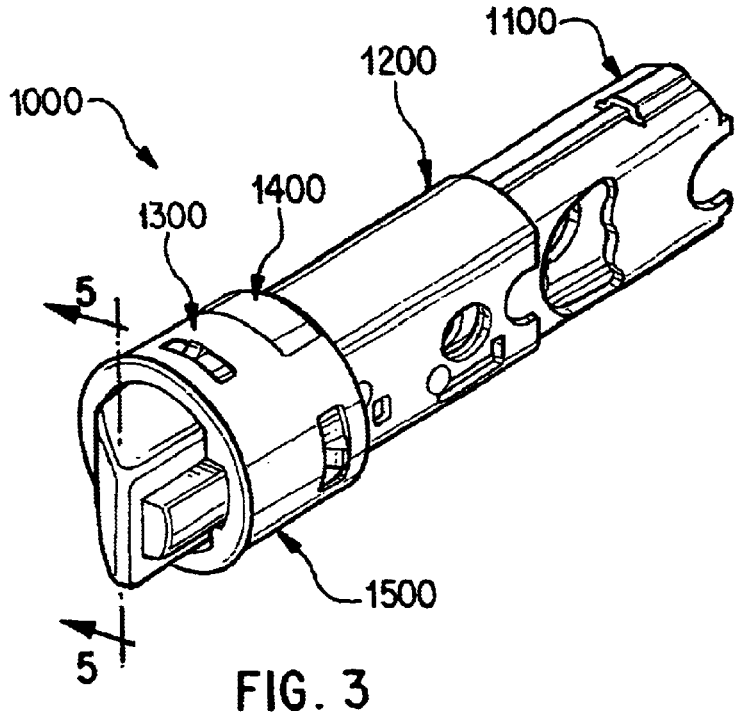
FIG. 3 is a front perspective view of an exemplary embodiment of a system 1000 of the present invention.

FIG. 3 is a front perspective view of an exemplary embodiment of a system 1000 of the present invention. In this particular exemplary embodiment, latch assembly 1100 is secured at least partially within casing 1200, a portion of which is surrounded by collar assembly 1300, which includes an inner collar 1400 and an outer collar 1500.

Figure 4:
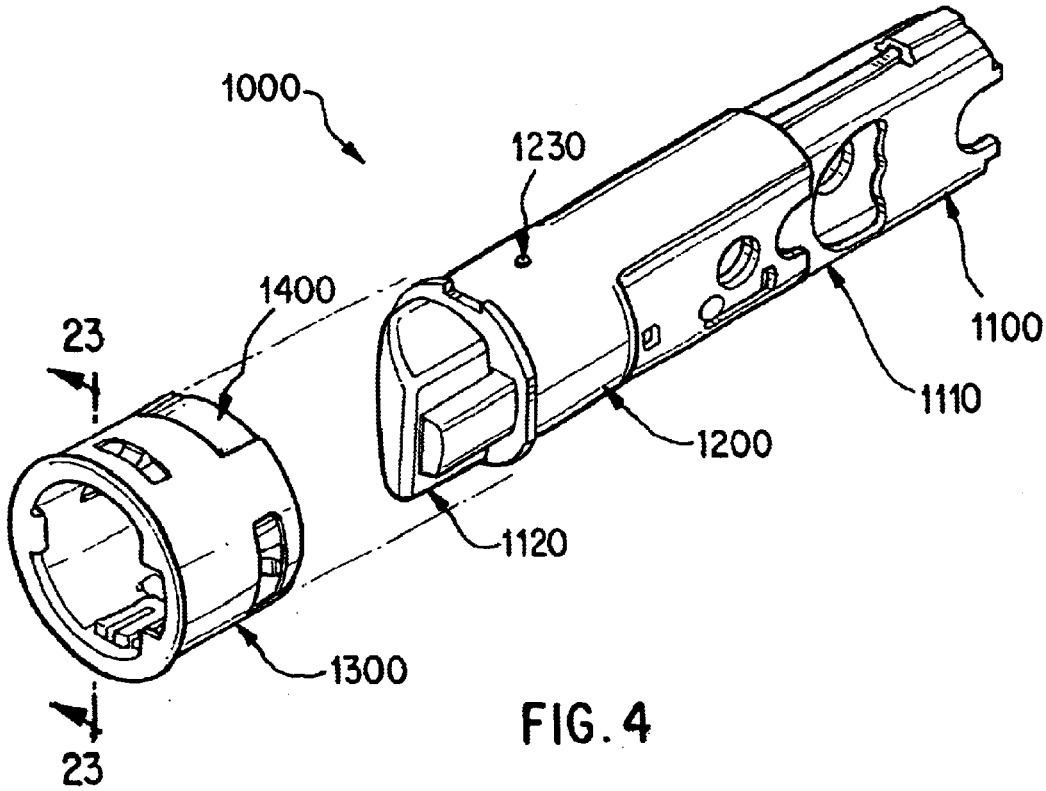
FIG. 4 is a front perspective assembly view of an exemplary embodiment of a system 1000 of the present invention.

FIG. 4 is a front perspective assembly view of an exemplary embodiment of a system 1000 of the present invention. In this particular exemplary embodiment, latch assembly 1100 has been slid inside of casing 1200, such that a rear portion 1110 of latch assembly 1100 is visible protruding from the rear of casing 1200. Also, a front portion 1120 of latch assembly 1100 is visible protruding from the front of casing 1200.

Collar assembly 1300 can be slid over casing 1200 by aligning groove 1450 (shown in FIG. 8) in inner collar 1400 of collar assembly 1300 with one or more alignment protrusions 1230 of casing 1200. Once collar assembly 1300 has been slid over casing 1200, alignment protrusion 1230 can reside within a circumferentially-extending rotational groove 1460 (shown in FIG. 8). The interaction of alignment protrusion 1230 with rotational groove 1460 can lock and/or limit the longitudinal movement of casing 1200 with respect to inner collar 1400. The interaction of alignment protrusion 1230 with rotational groove 1460 also can limit the rotational movement of casing 1200 with respect to inner collar 1400. If protrusion 1230 becomes realigned with alignment groove 1450, inner collar 1400 can be slidably removed from casing 1200. In an alternative embodiment, alignment protrusion 1230 can be integral to inner collar 1400, and alignment groove 1450 and rotational groove 1460 can be integral to casing 1200.

Once collar assembly 1300 is in place around casing 1200, the inner circumferential surface of inner collar 1400 can frictionally engage with the outer circumferential surface of casing 1200, providing at least slight resistance to relative movement between inner collar 1400 and casing 1200. Considering rotation, if sufficient differential torque is applied to inner collar 1400 with respect to casing 1200 to overcome the frictional engagement of inner collar 1400 and casing 1200, inner collar 1400 can only rotate with respect to casing 1200 until protrusion 1230 encounters the limit of groove 1460.

Figure 5:
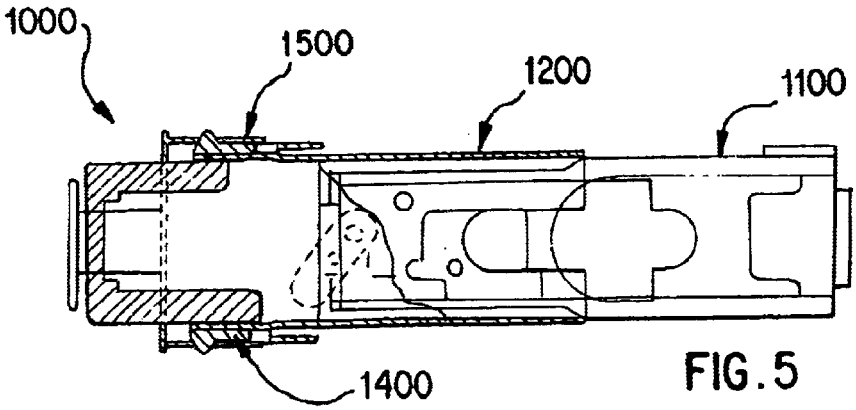
FIG. 5 is a section view of an exemplary embodiment of a system 1000 of the present invention taken along section lines 5—5 of FIG. 3.

FIG. 5 is a section view of an exemplary embodiment of a system 1000 of the present invention taken along section lines 5—5 of FIG. 3. In this particular exemplary embodiment, latch assembly 1100 has been slid inside of casing 1200, which has been slid inside of inner collar 1400, which has been slid inside of outer collar 1500.

Figure 6:
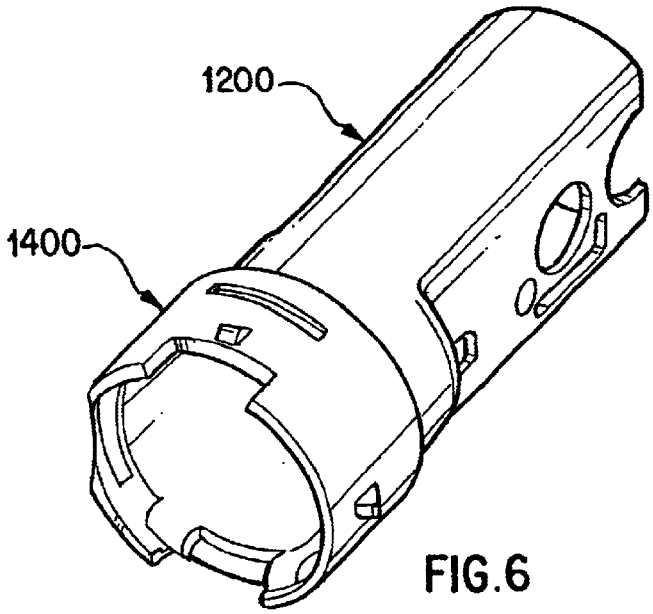
FIG. 6 is a 3-dimensional front perspective view of an exemplary embodiment of a casing 1200 and an inner collar 1400 of the present invention.
Figure 7:
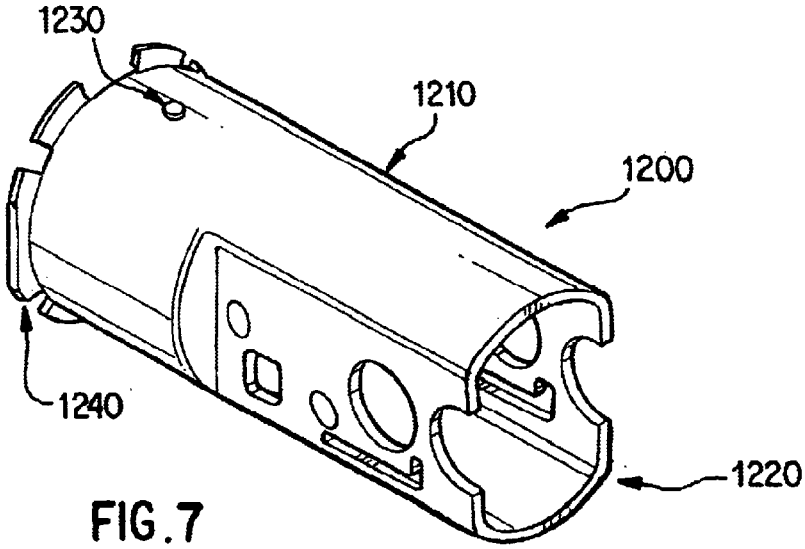
FIG. 7 is a 3-dimensional rear perspective view of an exemplary embodiment of a casing 1200 of the present invention.

FIG. 6 is a 3-dimensional front perspective view of an exemplary embodiment of a casing 1200 and an inner collar 1400 of the present invention. FIG. 7 is a 3-dimensional rear perspective view of an exemplary embodiment of a casing 1200 of the present invention. Visible from this view is the outer circumferential surface 1210 of casing 1200, as well as the latch chamber 1220 defined by casing 1200. Also visible is an alignment protrusion 1230 and a partial flange 1240.

Figure 8:
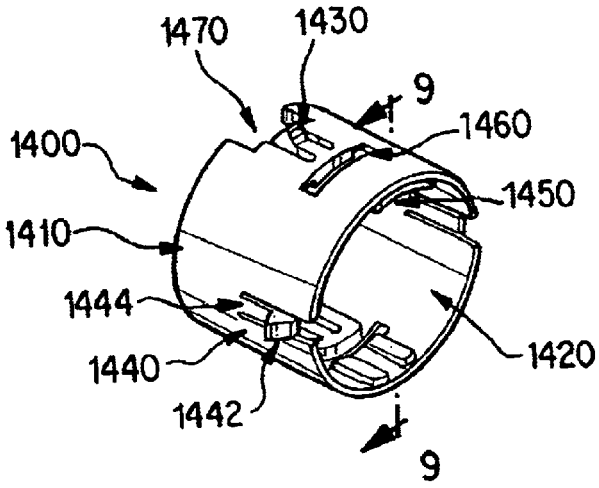
FIG. 8 is a rear perspective view of an exemplary embodiment of an inner collar 1400 of the present invention.

FIG. 8 is a rear perspective view of an exemplary embodiment of an inner collar 1400 of the present invention. Visible in this view is longitudinally-extending alignment groove 1450, circumferentially-extending rotational groove 1460, and front cut-out 1470. As shown for this particular exemplary embodiment, inner collar 1400 has a generally circumferential outer surface 1410 and a generally circumferential inner surface 1420. Inner collar 1400 also includes at least one front engagement mechanism 1430 and/or at least one rear engagement mechanism 1440.

Figure 9:
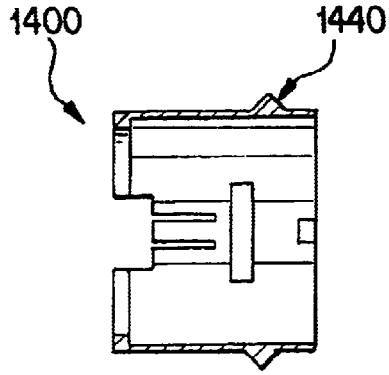
FIG. 9 is a section view of an exemplary embodiment of an inner collar 1400 of the present invention taken along section lines 9—9 of FIG. 8.
Figure 10:
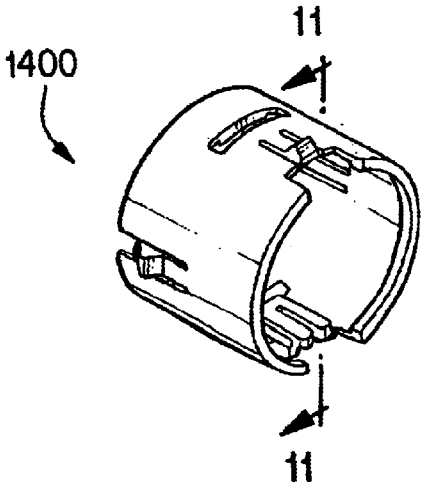
FIG. 10 is a front perspective view of an exemplary embodiment of an inner collar 1400 of the present invention.
Figure 11:
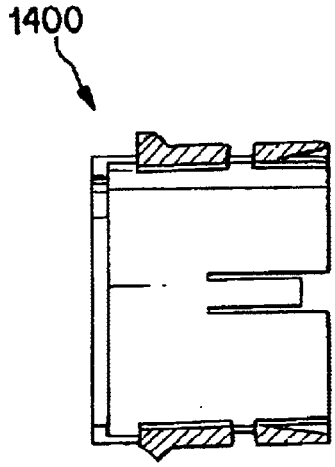
FIG. 11 is a section view of an exemplary embodiment of an inner collar 1400 of the present invention taken along section lines 11—11 of FIG. 10.
Figure 12:
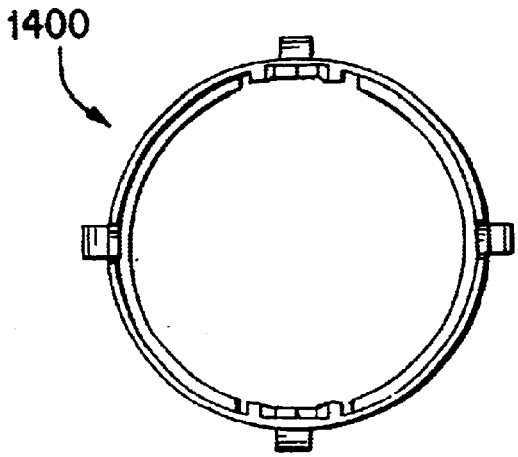
FIG. 12 is a rear view of an exemplary embodiment of an inner collar 1400 of the present invention.
Figure 13:
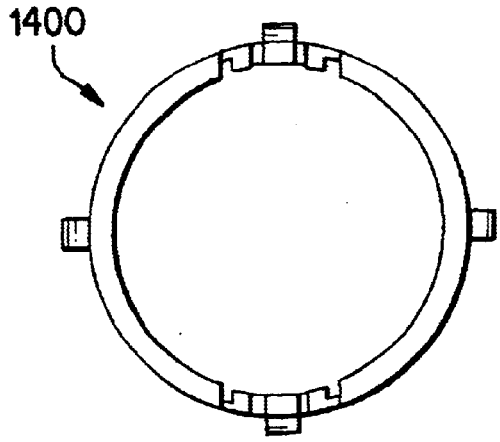
FIG. 13 is a front view of an exemplary embodiment of an inner collar 1400 of the present invention.

FIG. 9 is a section view of an exemplary embodiment of an inner collar 1400 of the present invention taken along section lines 9—9 of FIG. 8. FIG. 10 is a front perspective view of an exemplary embodiment of an inner collar 1400 of the present invention. FIG. 11 is a section view of an exemplary embodiment of an inner collar 1400 of the present invention taken along section lines 11—11 of FIG. 10. FIG. 12 is a rear view, and FIG. 13 is a front view, of an exemplary embodiment of an inner collar 1400 of the present invention.

Figure 14:
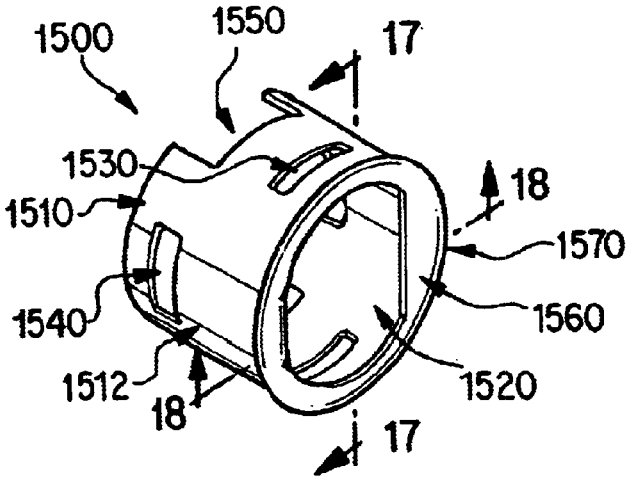
FIG. 14 is a front perspective view of an exemplary embodiment of an outer collar 1500 of the present invention.

FIG. 14 is a front perspective view of an exemplary embodiment of an outer collar 1500 of the present invention. Visible is generally cylindrical outer collar body 1510, which defines outer circumferential surface 1512 and inner circumferential surface 1520. Also visible is front engagement groove 1530, rear engagement groove 1540, rear cut-away 1550, faceplate 1560, and front flange 1570.

Figure 15:
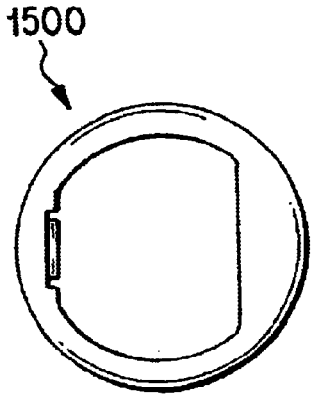
FIG. 15 is a front view of an exemplary embodiment of an outer collar 1500 of the present invention.
Figure 16:
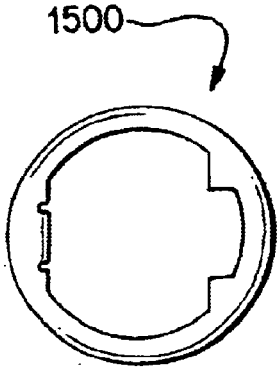
FIG. 16 is a front view of an exemplary embodiment of an outer collar 1500 of the present invention.

FIG. 15 is a front view of an exemplary embodiment of an outer collar 1500 of the present invention. FIG. 16 is a front view of an alternative exemplary embodiment of an outer collar 1500 of the present invention, with faceplate 1560 having a different configuration to accommodate a different latch style.

Figure 17:
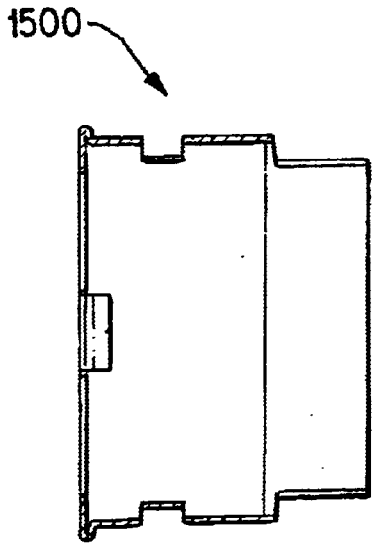
FIG. 17 is a section view of an exemplary embodiment of an outer collar 1500 of the present invention taken along section lines 17—17 of FIG. 14.
Figure 18:
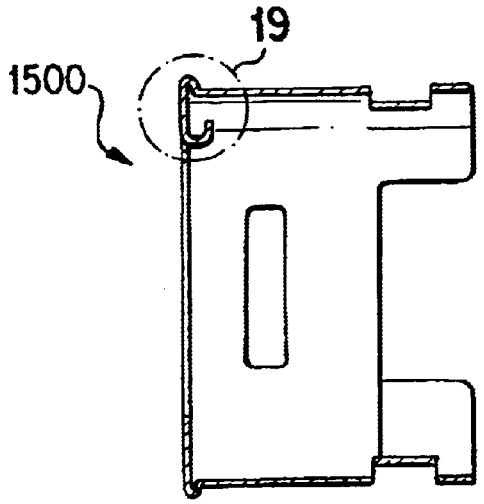
FIG. 18 is a section view of an exemplary embodiment of an outer collar 1500 of the present invention taken along section lines 18—18 of FIG. 14.
Figure 19:
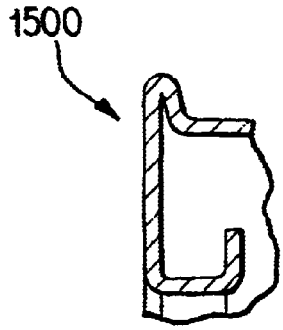
FIG. 19 is a detail view of an exemplary embodiment of an outer collar 1500 of the present invention taken at detail A of FIG. 18.

FIG. 17 is a section view of an exemplary embodiment of an outer collar 1500 of the present invention taken along section lines 17—17 of FIG. 14. FIG. 18 is a section view of an exemplary embodiment of an outer collar 1500 of the present invention taken along section lines 18—18 of FIG. 14. FIG. 19 is a detail view of an exemplary embodiment of an outer collar 1500 of the present invention taken at detail A of FIG. 18.

Figure 20:
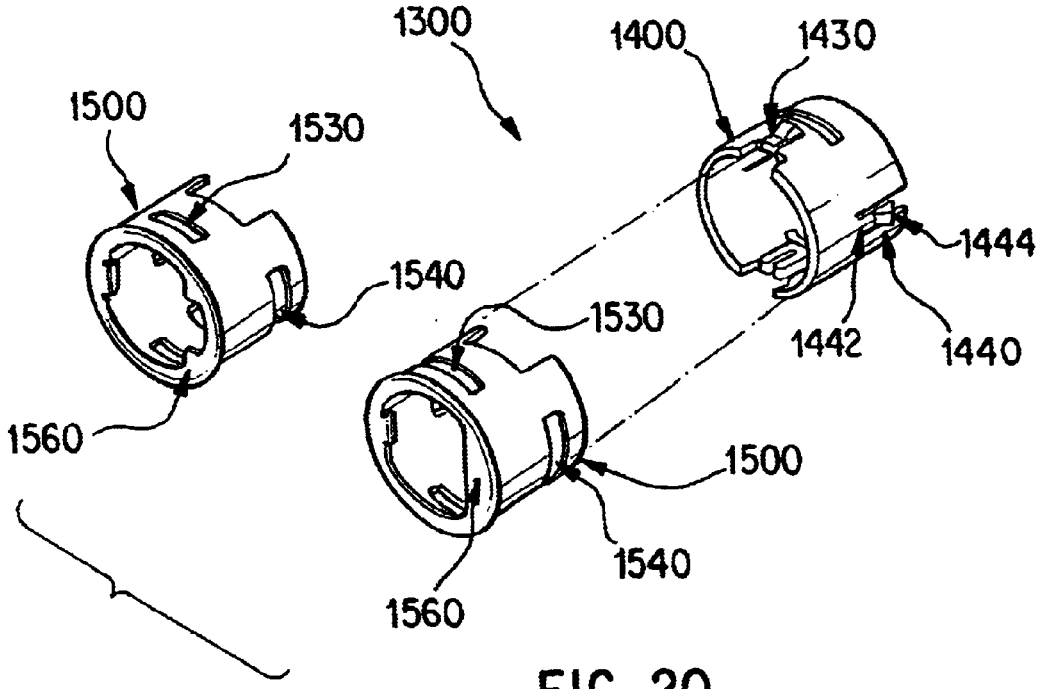
FIG. 20 is a front perspective assembly view of an exemplary embodiment of an collar assembly 1300 of the present invention.

FIG. 20 is a front perspective assembly view of an exemplary embodiment of a collar assembly 1300 of the present invention. In this particular exemplary embodiment, to form collar assembly 1300, an inner collar 1400 can be releasably slid inside of an outer collar 1500. Note that two alternatives are shown for outer collar 1500, which vary in the configuration of their faceplate 1560.

As shown, inner collar 1400 can include a front engagement mechanism 1430 and a rear engagement mechanism 1440. In certain embodiments, these engagement mechanisms 1430, 1440 can differ. In certain embodiments, engagement mechanisms 1430, 1440 can have similar or identical features. For example, engagement mechanism 1440 can include a tooth 1442 residing on the end of a springboard 1444. Tooth 1442 can be deflected radially inward toward a longitudinal axis of inner collar 1400 to allow inner collar 1400 to slide within outer collar 1500.

Once tooth 1442 encounters an appropriately sized open space in outer collar 1500, such as an engagement groove 1540, tooth 1442 is biased radially outward to return to its original position with respect to inner collar 1400. Thus, depending on the geometries of tooth 1442 and groove 1540, tooth 1442 can lock, and/or partially lock outer collar 1500 to inner collar 1400. In certain embodiments, this locking action can be releasable, manually and/or via the assistance of one or more tools.

Moreover, the inner surface of outer collar 1500 can frictionally engage with the outer surface of inner collar 1400. Thus, outer collar 1500 can at least slightly resist movement with respect to inner collar 1400. Considering rotation, if sufficient differential torque is applied to overcome the frictional engagement of outer collar 1500 and inner collar 1400, outer collar 1500 can only rotate with respect to inner collar 1400 until engagement mechanism 1440 encounters the limit of groove 1540.

When inner collar 1400 and outer collar 1500 are assembled into collar assembly 1300, a front engagement mechanism 1430 can interact with front engagement groove 1530, and a rear engagement mechanism 1440 can interact with rear engagement groove 1540. The interaction of engagement mechanisms 1430, 1440 and engagement grooves 1530, 1540 can prevent and/or resist longitudinal movement of inner collar 1400 with respect to outer collar 1500, and/or can limit rotational movement of inner collar 1400 with respect to outer collar 1500.

Outer collar 1500 can be rotationally linked to casing 1200 due to the shape of faceplate opening 1560 matching that of the front portion 1120 (sometimes called the latch bolt) of the latch assembly 1100.

Other means are possible for providing engagement mechanisms 1430, 1440. For example, springboard 1444 can be replaced with a Belville spring. As another example, if inner collar 1400 is of sufficient wall thickness, springboard 1444 can be replaced with a tooth attached to a coil spring recessed within the wall of inner collar 1400. Springboard 1444 can obtain its spring properties from any material possessing a shape memory, such as a thermoplastic, niconel, steel, etc. Tooth 1442 can be a single tooth, a ridge of teeth, a roughened surface, or any other means for securing inner collar 1400 within outer collar 1500 and/or for providing an interference fit with the door.

Moreover, the securing function can be provided separately from the interference function. For example, a rearward extending springboard 1444 could have a means for securing inner collar 1400 to outer collar 1500 (such as an engagement ridge, bump, or hemisphere located at some point along the length of springboard 1444). Alternatively, the securing function can be provided on outer collar 1500 and can engage with a feature in inner collar 1400.

Springboard 1444 (or a separate springboard, or other means as described previously) could have an interference-generating tooth located at its end, that end potentially extending beyond the overlap of inner collar 1400 and outer collar 1500. With this approach, the interference tooth could be replaced by an interference semi-ring that partially surrounds casing 1200 (possibly as an extension of inner collar 1400).

Front engagement mechanism 1430 and/or rear engagement mechanism 1440 can protrude beyond outer circumferential surface 1512 of body 1510 of outer collar 1500. The protrusion of the engagement mechanisms is apparent in FIGS. 21–23. This protrusion can allow front engagement mechanism 1430 and/or rear engagement mechanism 1440 to contact an inner surface of the bore of the door, thereby forming an releasable interference fit between inner collar 1400 and the door.

Figure 21:
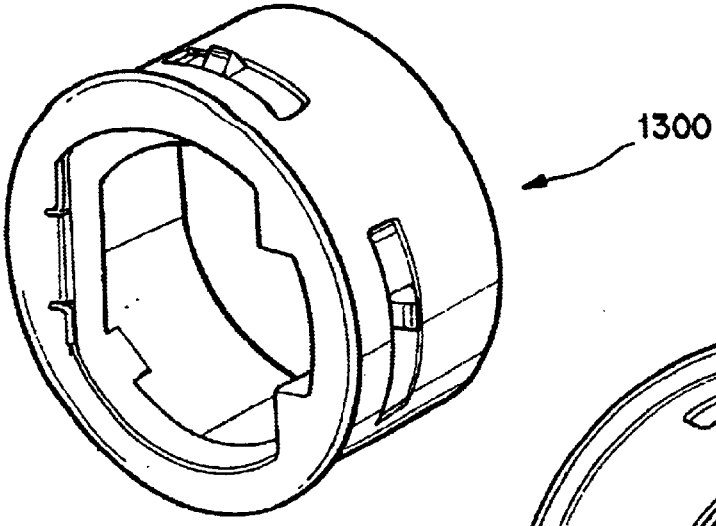
FIG. 21 is a 3-dimensional front perspective view of an exemplary embodiment of a collar assembly 1300 of the present invention.
Figure 22:
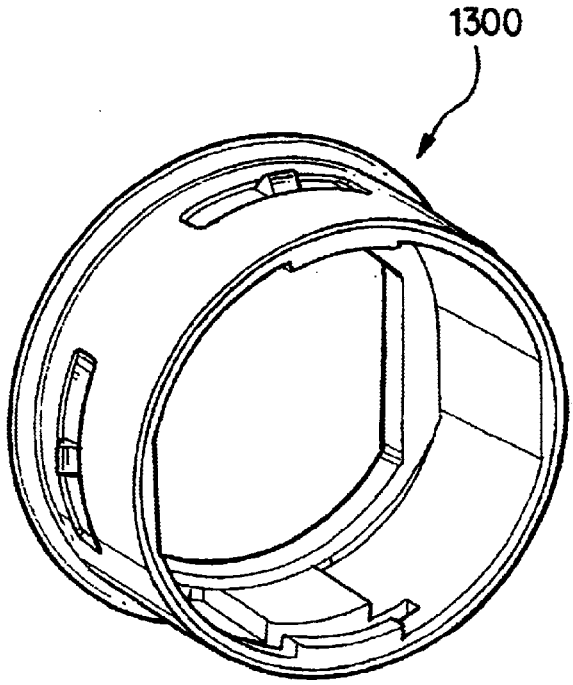
FIG. 22 is a 3-dimensional rear perspective view of an exemplary embodiment of a collar assembly 1300 of the present invention.
Figure 23:
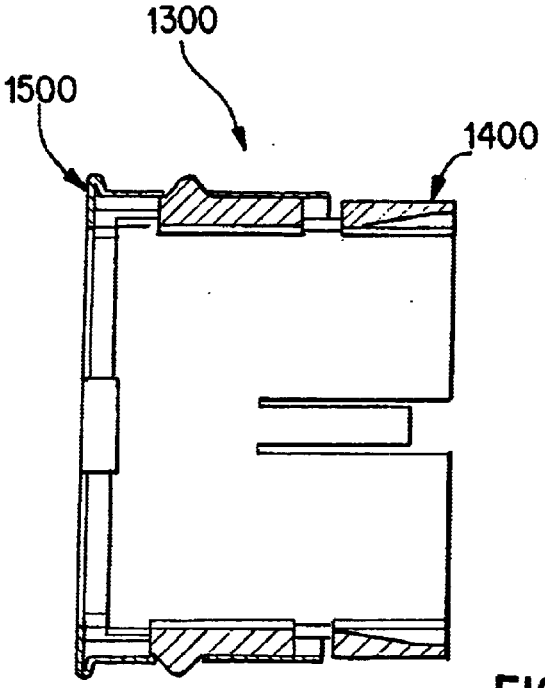
FIG. 23 is a section view of an exemplary embodiment of a collar assembly 1300 of the present invention taken along section lines 23—23 of FIG. 4.

FIG. 21 is a 3-dimensional front perspective view, and FIG. 22 is a 3-dimensional rear perspective view, of an exemplary embodiment of a collar assembly 1300 of the present invention. FIG. 23 is a section view of an exemplary embodiment of a collar assembly 1300 of the present invention taken along section lines 23—23 of FIG. 4.

Although the invention has been described with reference to specific exemplary embodiments thereof, it will be understood that numerous variations, modifications and additional embodiments are possible, and accordingly, all such variations, modifications, and embodiments are to be regarded as being within the spirit and scope of the invention. Also, references specifically identified and discussed herein are incorporated by reference as if fully set forth herein. Accordingly, the drawings and descriptions are to be regarded as illustrative in nature, and not as restrictive.

What is claimed is:

1. A removable drive-in housing assembly for securing a latch assembly in a door, the latch assembly including a latch bolt for latching the door in a predetermined position, said removable drive-in housing assembly comprising:

a. a cylindrical casing having a longitudinal axis, said casing adapted to at least partially surround the latch bolt;

b. a unitary cylindrical inner collar removably receivable around an outer circumference of said cylindrical casing; and c. a unitary cylindrical outer collar removably receivable around an outer circumference of said inner collar, the inner collar including a flexible member configured to engage the outer collar to removably retain the outer collar on the inner collar.

2. A removable drive-in housing assembly according to claim 1, wherein a combination of said inner collar and said outer collar is manually non-destructively removable from said cylindrical casing.

3. A removable drive-in housing assembly according to claim 1, wherein said outer collar is non-destructively removable from said inner collar.

4. A removable drive-in housing assembly according to claim 1, wherein said inner collar is longitudinally slidable around said outer circumference of said cylindrical casing.

5. A removable drive-in housing assembly according to claim 1, wherein said outer collar is locked longitudinally relative to the inner collar and slidable around said outer circumference of said inner collar.

6. A removable drive-in housing assembly according to claim 1, said cylindrical casing comprising at least one protrusion extending outward from said outer circumference of said cylindrical casing.

7. A removable drive-in housing assembly according to claim 1, said inner collar comprising at least one circumferential groove.

8. A removable drive-in housing assembly according to claim 1, said outer collar comprising at least one opening adapted to receive the flexible member of said inner collar to limit rotation of said outer collar with respect to said inner collar.

9. A removable drive-in housing assembly according to claim 1, said outer collar comprising at least one opening adapted to receive the flexible member of said inner collar to limit longitudinal movement of said outer collar with respect to said inner collar.

10. A removable drive-in housing assembly according to claim 1, the flexible member being adapted to releasably engage with the door.

11. A removable drive-in housing assembly according to claim 1, wherein, once installed in the door, the flexible member of said inner collar provides an interference fit with the door.

12. A removable drive-in housing assembly according to claim 1, wherein, once installed in the door, said outer collar is rotationally fixed with respect to said cylindrical casing.

13. A removable drive-in housing assembly according to claim 1, wherein, once installed in the door, said outer collar is rotationally adjustable with respect to said inner collar.

14. A removable drive-in housing assembly for securing a latch assembly in a door, said removable drive-in housing assembly comprising:

a. a cylindrical casing having a longitudinal axis, said casing adapted to at least partially surround the latch assembly, said cylindrical casing comprising at least one protrusion extending outward from an outer circumference of said cylindrical casing, said at least one protrusion slidable through an longitudinally-extending groove of said inner collar;

b. a unitary cylindrical inner collar removably receivable around an outer circumference of said cylindrical casing; and c. a unitary cylindrical outer collar removable around an outer circumference of said inner collar, the inner collar including a flexible member configured to engage the outer collar to removably retain the outer collar on the inner collar.

15. A removable drive-in housing assembly for securing a latch assembly in a door, said removable drive-in housing assembly comprising:

a. a cylindrical casing having a longitudinal axis, said casing adapted to at least partially surround the latch assembly, said cylindrical casing comprising at least one protrusion extending outward from an outer circumference of said cylindrical casing, said at least one protrusion receivable in a circumferential groove of said inner collar;

b. a unitary cylindrical inner collar removably receivable around an outer circumference of said cylindrical casing; and c. a unitary cylindrical outer collar removably receivable around an outer circumference of said inner collar, the inner collar including a flexible member configured to engage the outer collar to removably retain the outer collar on the inner collar.

16. A removable drive-in housing assembly for securing a latch assembly a door, said removable drive-in housing assembly comprising:

a. a cylindrical casing having a longitudinal axis, said casing adapted to at least partially surround the latch assembly, said cylindrical casing comprising at least one protrusion extending outward from an outer circumference of said cylindrical casing, said at least one protrusion receivable in a circumferential groove of said inner collar, said circumferential groove limiting rotation of said cylindrical casing with respect to said inner collar;

b. a unitary cylindrical inner collar removably receivable around an outer circumference of said cylindrical casing; and c. a unitary cylindrical outer collar removably receivable around an outer circumference of said inner collar, the inner collar including a flexible member configured to engage the outer collar to removably retain the outer collar on the inner collar.

17. A removable drive-in housing assembly for securing a latch assembly in a door, said removable drive-in housing assembly comprising:

a. a cylindrical casing having a longitudinal axis, said casing adapted to at least partially surround the latch assembly, said cylindrical casing comprising at least one protrusion extending outward from an outer circumference of said cylindrical casing, said at least one protrusion receivable in a circumferential groove of said inner collar, said circumferential groove limiting longitudinal movement of said cylindrical casing with respect to said inner collar;

b. a unitary cylindrical inner collar removably receivable around an outer circumference of said cylindrical casing; and c. a unitary cylindrical outer collar removably receivable around an outer circumference of said inner collar, the inner collar including a flexible member configured to engage the outer collar to removably retain the outer collar on the inner collar.

18. A removable drive-in housing assembly for securing a latch assembly in a door, said removable drive-in housing assembly comprising:

a. a cylindrical casing having a longitudinal axis, said casing adapted to at least partially surround the latch assembly;

b. a unitary cylindrical inner collar removably receivable around an outer circumference of said cylindrical casing, said inner collar comprising a circumferential groove, said circumferential groove adapted to releasably receive a protrusion extending outward from said outer circumference of said cylindrical casing; and c. a unitary cylindrical outer collar removably receivable around an outer circumference of said inner collar, the inner collar including a flexible member configured to engage the outer collar to removably retain the outer collar on the inner collar.

19. A removable drive-in housing assembly for securing a latch assembly in a door, said removable drive-in housing assembly comprising:

a. a cylindrical casing having a longitudinal axis, said casing adapted to at least partially surround the latch assembly;

b. a unitary cylindrical inner collar removably receivable around an outer circumference of said cylindrical casing; and c. a unitary cylindrical collar removably receivable around an outer circumference of said inner collar, the inner collar including a flexible member configured to engage the outer collar to removably retain the outer collar on the inner collar, wherein said outer collar is metallic.

20. A removable drive-in housing assembly for securing a latch assembly in a door, said removable drive-in housing assembly comprising:

d. a cylindrical casing having a longitudinal axis, said casing adapted to at least partially surround the latch assembly;

e. a unitary cylindrical inner collar removably receivable around an outer circumference of said cylindrical casing; and f. a unitary cylindrical outer collar removably receivable around an outer circumference of said inner collar, the inner collar including a flexible member configured to engage the outer collar to removably retain the outer collar on the inner collar, wherein said inner collar is plastic.

21. A removable drive-in housing assembly for securing a latch assembly in a door, said removable drive-in housing assembly comprising:

a. a first means for releasably engaging a unitary cylindrical inner collar around a cylindrical casing having a longitudinal axis, said casing adapted to at least partially surround the latch assembly, said inner collar adapted to releasably engage with the door, said first means limiting longitudinal and rotational movement of said inner collar with respect to said casing;

b. a second means for releasably engaging a unitary cylindrical outer collar around said inner collar, said second means limiting longitudinal and rotational movement of said outer collar with respect to said inner collar.

22. A system comprising:

a. a second means for latching a door in a predetermined position;

b. a third means for securing said second means in the door, c. a fourth means, removably receivable around an outer perimeter of said third means, for limiting rotation of said third means with respect to the door; and d. a fifth means, removably receivable around an outer perimeter of said fourth means, for allowing adjustment of a rotational position of said third means with respect to the door, e. a combination of said fifth means, said fourth means, and said third means adapted to be driven into the door and non-destructively removable from the door.

* * * * *